US007527268B2

(12) United States Patent
Scapaticci

(10) Patent No.: US 7,527,268 B2
(45) Date of Patent: May 5, 2009

(54) METHOD FOR PLAYING A POKER GAME

(76) Inventor: John Dominick Scapaticci, 33 Hampton Ct., Coram, NY (US) 11727

( * ) Notice: Subject to any disclaimer, the term of this patent is extended or adjusted under 35 U.S.C. 154(b) by 453 days.

(21) Appl. No.: 11/382,731

(22) Filed: May 11, 2006

(65) Prior Publication Data

US 2007/0262525 A1 Nov. 15, 2007

(51) Int. Cl.
*A63F 1/00* (2006.01)

(52) U.S. Cl. ..... 273/292; 273/274

(58) Field of Classification Search ..... 273/292, 273/274, 309; 463/13, 12
See application file for complete search history.

(56) References Cited

U.S. PATENT DOCUMENTS 5,791,652 A * 8/1998 Nielsen ..... 273/305

6,179,290 B1 * 1/2001 Maahs ..... 273/292

OTHER PUBLICATIONS

"Pass the Garbage", "Basketball", "Anaconda", "Screwy Louie", Scarne's Encyclopedia of Games, John Scarne, Harper & Row Publishers, 1973, pp. 44-45.*

* cited by examiner

*Primary Examiner*—Benjamin H Layno

(57) ABSTRACT

This variation of 5-card poker is played with a standard poker deck (52 cards), and uses the standard valuation of hands. During play, the players are playing both their own hand and a "party hand". Improving one's hand, and, if applicable, wagering, requires exchanging cards from the hand one is playing with the party hand, with the restriction that the party hand must be improved using a standard poker ranking system. Both hands the public and the private will then split the pot.

25 Claims, No Drawings

METHOD FOR PLAYING A POKER GAME

BACKGROUND OF THE INVENTION

Poker is a card game, the most popular of a class of games called vying games, in which players with fully or partially concealed cards make wagers into a central pot, which is awarded to the player or players with the best combination of cards. Poker can also refer to video poker which is a single-player game seen in casinos much like a slot machine, or to other games that use poker hand rankings. Cited from Wikipedia-"Poker"-Feb. 13, 2006

The most common ranking of hands is as follows:

Royal flush: Five cards in sequence and of the same suit, starting from the Ace down to the 10. Example: A of clubs, K of clubs, Q of clubs, J of clubs, 10 of clubs (Note: A Royal Flush is not a category of hand in and of itself, it is simply the highest-valued straight flush, and thus also the highest-valued hand. Since it is mentioned often in the context of hand rankings, it is worth noting in this list.)

Straight flush: Any five cards in sequence and of the same suit. Example: Q of Diamonds, J of Diamonds, 10 of Diamonds, 9 of Diamonds, 8 of Diamonds Four of a kind: A hand with four cards of the same rank. Example: 4 of clubs, 4 of Diamonds, 4 of Hearts, 4 of Spades, 9 of Hearts Full house: A hand with three cards of one rank and two of another. Example: 8 of Clubs, 8 of Diamonds, 8 of Spades, K of Hearts, K of Spades Flush: Five cards of the same suit. Example: K of Clubs, J of Clubs, 8 of Clubs, 4 of Clubs, 3 of Clubs Straight: Five cards in sequence. (The ace can be considered higher than the king, or lower than the two.) Example: 5 of Diamonds, 4 of Hearts, 3 of Clubs, 2 of Diamonds, A of Diamonds Three of a kind: Three cards of the same rank. Example: 7 of Clubs, 7 of Hearts, 7 of Spades, K of Diamonds, 2 of Clubs Two pair: Two cards of one rank, two of another. Example: A of Clubs, A of Diamonds, 8 of Hearts, 8 of Clubs, Q of Clubs One pair: Two cards of the same rank. Example: 9 of Hearts, 9 of Spades, A of Clubs, J of Spades, 4 of Hearts No pair: Also known as a high card hand. The following example is considered "Ace high." Example: A of Diamonds, 10 of Diamonds, 9 of Spades, 5 of Clubs, 4 of Clubs Cited from Wikipedia—"Poker Hand Rankings" —Feb. 13, 2006

The present invention, public or "pub" poker, relates to a new type of poker game for card room play or casino gambling, both in live table and electronic video formats. This variant introduces and employs a novel method for both building your hand, for wagering, and payout.

This variation of poker was originally designed for card room play, and as such holds no special consideration for the dealer (for a casino setting), who may opt to play or not. As a result, it is recommended that when adapted for such use, the dealer receive a percentage of the "pot" (a rake), in return for his/her services. In addition, the game is intended for use with a single 52-card deck, although a multiple deck "shoe" could be substituted.

SUMMARY OF THE INVENTION

Wherein, most poker games will have each player playing one or multiple hands, that are not shared with the other players, though they may or may not use some "communal" cards, this game presents two hands to each player, one private, and one public. The public hand is shared among all players and is integral to the ability to set a wager. As such, it introduces new elements in both betting and playing strategy. To increase the tension, the accumulated wagers (the Pot) are at the end of the hand split between the player holding the best (see above for rankings) private hand, and the player that won (see detailed description, below) the public hand.

Broadly, this invention describes that variation of poker wherein a number of players (at least 3, at most 9, given a standard deck of 52 cards), play a 5 card poker game (or optionally, at least 3, at most 6 for a 7 card variation), where improvement of a shared public hand is necessary to place an additional wager and potentially increase the hand you are holding, and wherein the accumulated wagers are then divided between two of the players.

The preferred embodiment of this invention is as follows, consisting of the Deal, Play and Betting, and Winning and Splitting the Pot.

Deal

The dealer shuffles the cards, offers the person seated to his right the option of cutting the deck, and proceeds to deal (clockwise) 1 card to each player, face down. After dealing himself a card, he places a card face up in the center. At the end of the deal, each player should have a 5-card hand, and there should be a 5-card hand face up in the center, this is the "party hand". The remaining cards are put to the side and are not used during play.

Play and Betting

Before the deal, each player places the minimum bet "ante" to play. Play begins with the person on the left of the dealer and proceeds clockwise. During each persons turn, they have the choice to fold, check, call, or bet/raise. When folding, the player discards his hand, facedown, and is out of the game. If no bet is outstanding, and a player does not wish to or cannot, bet, he may check, play proceeds to the next person. If a bet is outstanding, a player must either raise (see following) or call in order to continue playing. To call (or see), a person must bet the amount currently outstanding to him. To bet or raise, a player must be able to improve the "party hand" by swapping a card from his hand to the "party hand". He may bet any amount (as determined by the table). For example, if the current party hand is A-Q-8-7-5, a person may swap an 8 from his hand for the Queen in the party hand, bringing the party hand from an "Ace high" to a "pair of eights". You must improve the party hand on your turn to place a bet or raise. Conversely, you must make a bet or raise if you wish to swap with the party hand. Unlike other games of poker, a player may raise himself if he continues to improve the "party hand".

Winning and Splitting the Pot

Once a full round (all players) passes with no additional raises/bets. The hand is over and winners are determined. The pot is split between the person holding the best hand (in hand), and the person who most recently improved the "party hand" (last person to bet/raise). The split is down to the minimum denomination used in betting with the extra, if available, going to the person with the winning hand (in hand). For example, if at the end of play, there is $275 in the pot with a minimum $5 chip or token, then the person winning the "party hand" would receive $135, while the person with the winning hand (in-hand) would take $140.

DETAILED ILLUSTRATION OF PLAY

To better illustrate the nature of game play, an example hand follows. For this illustration there are 4 players. The cards are denominated as A(ace), K(king), Q(Queen), J(Jack), 10-2 and the suits as S(spades), H(hearts), D(diamonds), C(clubs). This illustration assumes a $5 minimum wager and $5 ante. After the deal, the players (1-4) and the party hand (P) appear as follows:

1—AC, AS, AD, 2S, 7H

2 —9C, 8H, 3H, 5H,JS

3—KS, 10C, 8C, 2D, 8D

4 —9H,JC, 9S, 4H, 6S

P—KH, QS, 10S, 2C, 4S

Player 1 begins with a $10 wager and exchanges his 7H for the 2C. This has improved the party hand from K, Q, 10, 4 to K, Q, 10, 7 and as such is valid.

Player 2 "sees" the $10 wager to remain in the game.

Player 3 then increases the wager $5 and exchanges his 10C for the KH. This has improved the party hand from K high to a pair of 10s and as such is valid.

Player 4 then increases the wager an additional $5 and exchanges his 6S for the 4S. As the "support" for the pair has gone from Q, 10, 4 to Q, 10, 6, this is valid.

At the end of the first round, the hands are as follows:

1—AC, AS, AD, 2S, 2C ($10 to remain in game)

2—JS, 9C, 8H, 5H, 3H ($10 to remain in game)

3—KS, KH, 8C, 8D, 2D ($5 to remain in game)

4—9H, 9S,JC, 4H, 4S

P—10C,QS, 10S, 7H, 6S

The pot is currently at $75 ($20 ante, $55 in additional wagers)

Player 1 sees the $10 currently owed, but does not bet (not wishing to disturb his hand)

Player 2 sees the $10currently owed, and raises $5, exchanging his JS for the 7H.

Player 3 sees the $10 currently but does not bet

Player 4 sees the $5 currently owed, and raises $5, exchanging his JC for the QS At the end of the second round, the hands are as follows:

1—AC, AS, AD, 2S, 2C ($10 to remain in game)

2—9C, 8H, 7H, 5H, 3H ($5 to remain in game)

3—KS, KH, 8C, 2D, 8D ($5 to remain in game)

4—9H, 9S, 4H, 4S,QS

P—10C, JC, 10S, JS, 6S

The pot is currently at $120

Player 1 sees the $10 currently owed

Player 2 sees the $5 currently owed and bets $5 exchanging his 9C for the 6S

Player 3 sees the $10 currently owed

Player 4 sees the $5 currently owed and bets $10 exchanging his QS for the 9C

As play might continue . . .

Player 1 sees the $15 currently owed

Player 2 folds

Player 3 sees the $10 currently owed

As play has now returned to player 4 with no additional betting, the game is concluded and all hands (except for player 2, as he had folded, removing himself from the game) are shown. The final standing is as follows:

1—AC, AS, AD, 2S, 2C

3—KS, KH, 8C, 8D, 2D

4—9C, 9H, 9S, 4H, 4S

P—JS,JC, 10C, 10S, QS

The pot is currently at $190. The pot is then split evenly between player 1 (holding the best "private" hand with the Aces over 2s full house) and player 4 who, in placing the final bet, has won the public hand.

What is claimed is:

1. A method of playing poker, comprising the steps of:

Dealing a predetermined number of cards (a hand) to each of at least three players face-down (private hands), and an additional hand comprised of the same number of cards, face-up for public play allowing each player the option of exchanging at least one card between a private hand held by a player and the public hand by moving at least one selected card from the private hand to the public hand, and by moving at least one selected card from the public hand to the private hand with such an exchange requiring that the public hand be of a higher poker value (rank and support) after the exchange play proceeding to the next player allowing the next player the option of exchanging at least one card in the next player's hand with a card in the public hand, and wherein two winners are determined, the first by comparing each private hand using poker rank as the criterion for determining the winner between the at least three players, and the second to be the player responsible for the final improvement of the public hand one player may win both hands.

2. The method of claim 1 further requiring that to make an exchange with public hand requires a wager, or an increase to the current wager and further requiring that in order to make such a wager, or an increase to the current wager, such an exchange needs to be made.

3. The method of claim 2 further requiring an initial bet, or ante, to participate in play.

4. The method of claim 3 wherein the final accumulated wagers are divided between the winners of the private and public hands, the same player may be entitled to claim both.

5. The method of claim 4 wherein the dealer receives a percentage of the accumulated wagers for his services.

6. The method of claim 2 wherein the final accumulated wagers are divided between the winners of the private and public hands, the same player may be entitled to claim both.

7. The method of claim 6 wherein the dealer receives a percentage of the accumulated wagers for his services.

8. The method of claim 1 wherein said predetermined number of cards is 5.

9. The method of claim 8 further requiring that to make an exchange with public hand requires a wager, or an increase to the current wager and further requiring that in order to make such a wager, or an increase to the current wager, such an exchange needs to be made.

10. The method of claim 9 further requiring an initial bet, or ante, to participate in play.

11. The method of claim 10 wherein the final accumulated wagers are divided between the winners of the private and public hands, the same player may be entitled to claim both.

12. The method of claim 11 wherein the dealer receives a percentage of the accumulated wagers for his services.

13. The method of claim 9 wherein the final accumulated wagers are divided between the winners of the private and public hands, the same player may be entitled to claim both.

14. The method of claim 13 wherein the dealer receives a percentage of the accumulated wagers for his services.

15. The method of claims 8, 9, 10, 13, 11, 14 or 12 wherein said poker game is played on an electronic device and said cards comprise electronically produced visual representations of playing cards.

16. The method of claim 8, 9, 10, 13, 11, 14 or 12 wherein said poker game is played in a live form on a gaming table with a human dealer and conventional playing cards.

17. The method of claim 1 wherein said predetermined number of cards is 7.

18. The method of claim 17 further requiring that to make an exchange with public hand requires a wager, or an increase to the current wager and further requiring that in order to make such a wager, or an increase to the current wager, such an exchange needs to be made.

19. The method of claim 18 further requiring an initial bet, or ante, to participate in play.

20. The method of claim 19 wherein the final accumulated wagers are divided between the winners of the private and public hands, the same player may be entitled to claim both.

21. The method of claim 20 wherein the dealer receives a percentage of the accumulated wagers for his services.

22. The method of claim 18 wherein the final accumulated wagers are divided between the winners of the private and public hands, the same player may be entitled to claim both.

23. The method of claim 22 wherein the dealer receives a percentage of the accumulated wagers for his services.

24. The method of claims 17, 18, 19, 22, 20, 23 or 21 wherein said poker game is played on an electronic device and said cards comprise electronically produced visual representations of playing cards.

25. The method of claim 17, 18, 19, 22, 20, 23 or 21 wherein said poker game is played in a live form on a gaming table with a human dealer and conventional playing cards.

* * * * *